US005586877A

United States Patent [19]

Charmes

[11] Patent Number: 5,586,877

[45] Date of Patent: Dec. 24, 1996

[54] INFRARED RAY EMITTERS WITH CATALYTIC BURNER

[75] Inventor: Michel Charmes, Lyons, France

[73] Assignee: A.J.C., Sathonay Camp, France

[21] Appl. No.: 504,946

[22] Filed: Jul. 20, 1995

[51] Int. Cl.[6] ..... F23D 14/12

[52] U.S. Cl. ..... 431/115; 431/326; 431/328; 431/208; 431/7; 431/5; 432/176

[58] Field of Search ..... 431/115, 7, 5, 431/170, 326, 328, 8, 208, 11, 116; 432/72, 176

[56] References Cited

U.S. PATENT DOCUMENTS

| | | | |
|---|---|---|---|
| 3,238,991 | 3/1966 | Goldmann et al. | 431/116 |
| 3,437,085 | 4/1969 | Perry | 431/115 |
| 3,922,136 | 11/1975 | Koch | 431/115 |
| 4,508,669 | 4/1985 | Iwai et al. | 432/72 |

FOREIGN PATENT DOCUMENTS

| | | | |
|---|---|---|---|
| 599739 | 6/1960 | Canada | 432/176 |
| 0023716 | 2/1982 | Japan | 431/7 |

*Primary Examiner*—Carl D. Price
*Attorney, Agent, or Firm*—Dowell & Dowell

[57] ABSTRACT

An infrared ray emitter with catalytic burner including a box having an opening covered by a catalytic structure and wherein a supply of combustion gas is applied adjacent the catalytic structure and a supply of recirculating gas is introduced into the box by a fan driven by a motor which extends exteriorly from a furnace in which the emitter is mounted. Brackets are provided to mount the box within a furnace in such a manner that the emitter may be angularly adjusted with respect to the support brackets.

7 Claims, 3 Drawing Sheets

INFRARED RAY EMITTERS WITH CATALYTIC BURNER

BACKGROUND OF THE INVENTION

1. Field of the Invention

The present invention relates to infrared ray emitters with catalytic burner and more particularly to such an apparatus which constitutes a monobloc assembly adapted to be installed in a furnace or the like.

2. History of the Related Art

Such infrared ray emitters adapted to be installed in furnaces, tunnels or ovens intended more particularly for the drying or polymerization of liquid or powder paints on various supports, are known.

In accordance with the known art, there are disposed on the internal walls of furnaces or the like catalytic burners each comprising a frame which supports a catalytic structure composed of an element impregnated with a catalytic combustion matter. Outside the partitions of the furnaces thus equipped, there are provided pipes for conducting the combustible gas which terminate in each burner at a Venturi ensuring air/gas pre-mix, leads for conducting electric current for the resistors for pre-heating the catalytic structures and finally conduits for diffusing the air generated by a turbine air generator so as to diffuse air onto the surface of the catalytic structures.

It will be appreciated that such a construction is complex, resulting in the cost of a furnace or the like thus equipped being very high.

It is an object of the improvements forming the subject matter of the present invention to overcome these drawbacks and to provide an infrared ray emitter with catalytic burner which constitutes a monobloc assembly installed inside a furnace or the like, of which the assembly of the components allows functioning at high temperatures, of the order of 250° C., while comprising means for recycling the gaseous medium contained in the furnace by oxidation without flame of the solvents given off by the paint.

SUMMARY OF THE INVENTION

To that end, the infrared ray emitter with catalytic burner according to the invention which is adapted to be installed in a furnace or the like, comprises:

- a box of which a large face is open;
- a catalytic structure disposed in the open face of the box;
- a member for injecting combustible gas;
- a turbine air generator sending air under pressure in the box which includes a chamber for distributing air over the whole catalytic structure;
- an electrical system for preheating the catalytic structure;
- the turbine of an air generator, which is driven from outside the furnace, and electric controls for the electrical preheating system.

According to an advantageous embodiment, the box is mounted between two brackets secured to one of the walls of the furnace or the like, one of the brackets being assembled on a base to which is fixed the housing of the turbine of the air generator. This turbine is fixed on a shaft which traverses the wall of the furnace on which the brackets are fixed and cooperates outside the furnace with the device for driving the turbine. The box is preferably mounted to be adjustable with respect to the brackets.

BRIEF DESCRIPTION OF THE DRAWINGS

The invention will be more readily understood on reading the following description with reference to the accompanying drawings, in which.

DESCRIPTION OF PREFERRED EMBODIMENT

Figure 1:
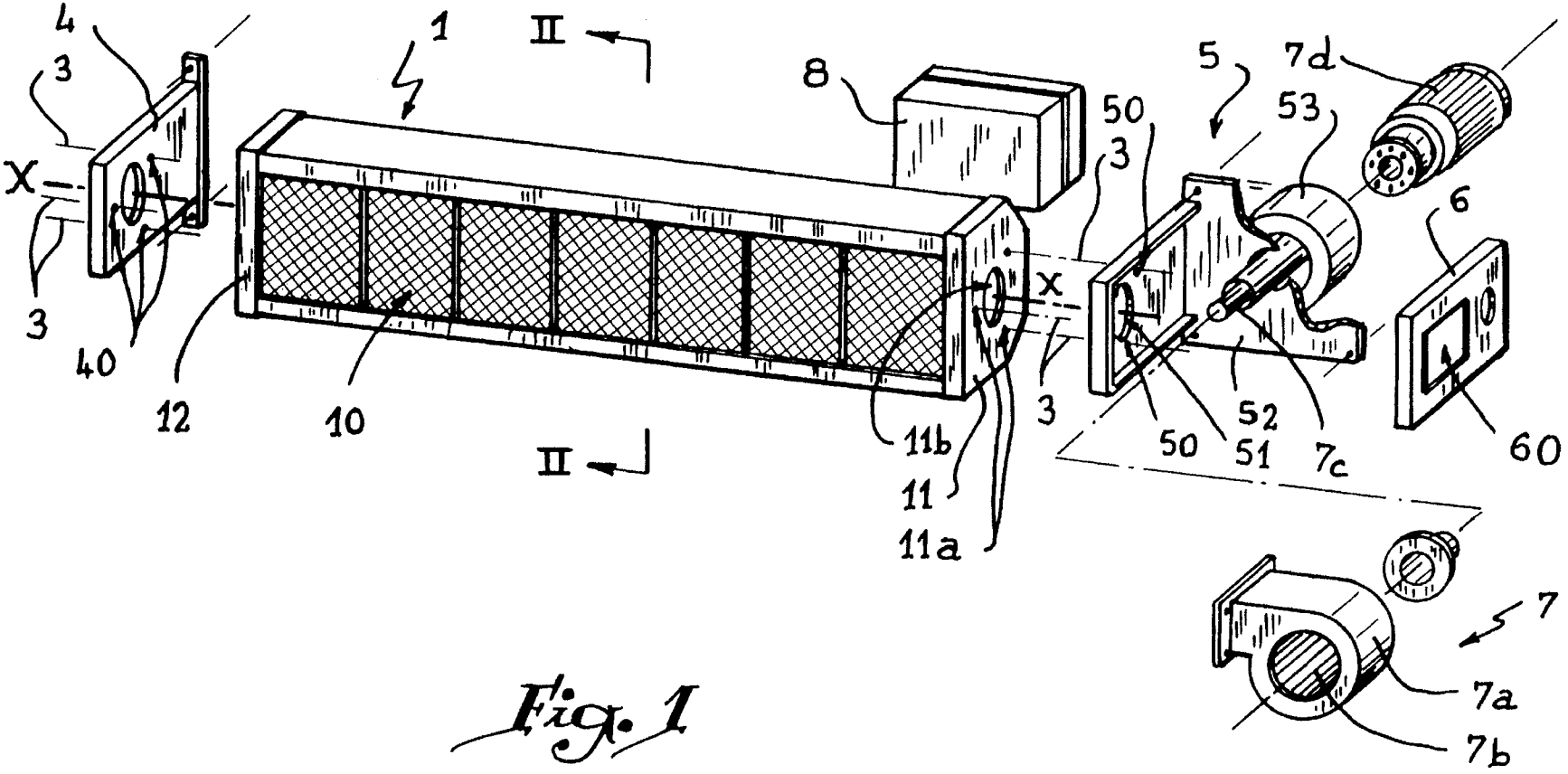
FIG. 1 is an exploded view in perspective of an infrared ray emitter according to the invention.

Referring now to the drawings, the infrared ray emitter shown in FIG. 1 essentially comprises a box 1 made in the form of an elongated parallelepiped closed on five of its faces, with the large face 10 being open.

Figure 2:
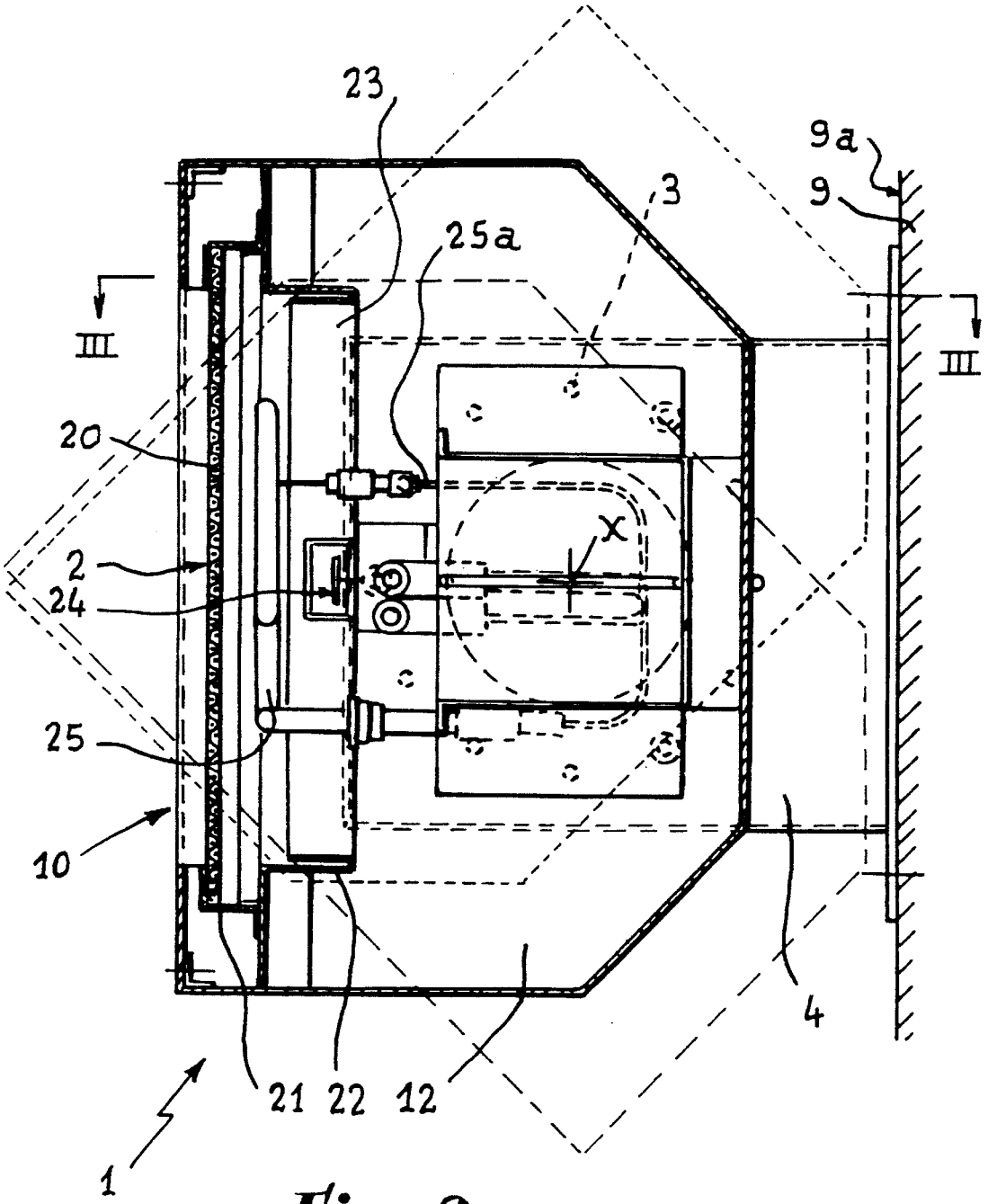
FIG. 2 is a section thereof along II—II (FIG. 1).

As illustrated in FIG. 2, a catalytic structure 2 is disposed in the open face 10 of the box 1. This structure is composed of an element 20 impregnated with a catalytic combustion matter such as platinum. This element, which is permeable by a gaseous mixture to be burned, is constituted by an inert support such as glass fiber or the like adapted to resist the high temperatures generated by catalytic combustion. Such a structure is well known in the art and will not be described further.

Element 20 is supported by a frame 21 fixed tightly with respect to the open face 10 of the box 1. It is observed that the frame 21 is associated with a chassis 22 which determines a space corresponding to the section of the large open face 10 of the box 1. A distance piece 23 whose ends are fixed to the chassis 22 supports a member 24 for injecting a combustible gas mixed with air and opening out on the inner face of the element 20, as is well known in the art. The distance piece 23 also supports at least one electrical resistor 25 for preheating the impregnated element 20.

As illustrated in FIG. 1, the box 1 comprises two end walls 11 and 12 which are respectively fixed to spaced brackets 4, 5. Each of the latter is provided with a ring of holes 40, 50 in each of which may be engaged a screw 3 which is screwed in a corresponding tapped hole 11*a*, 12*a* in the end walls 11, 12. Bracket 5 is in the form of a square bracket, as will be better explained hereinafter. Bracket 5 is assembled on a support plate 6 on which is mounted the housing 7*a* of an electro-ventilator 7. In this way, by modifying the angular position of the box 1 with respect to the brackets 4, 5, the box may be oriented in the desired direction, as illustrated in discontinuous lines in FIG. 2. The turbine 7*b* of the electro-ventilator which is located in the housing 7*a* is fitted on one of the ends of a shaft 7*c*of which the other end is assembled on the driven shaft of electric motor 7*d* of the electro-ventilator 7. The shaft 7*c* is oriented perpendicularly to the general direction of the box, as will be better explained herein after.

Figure 3:
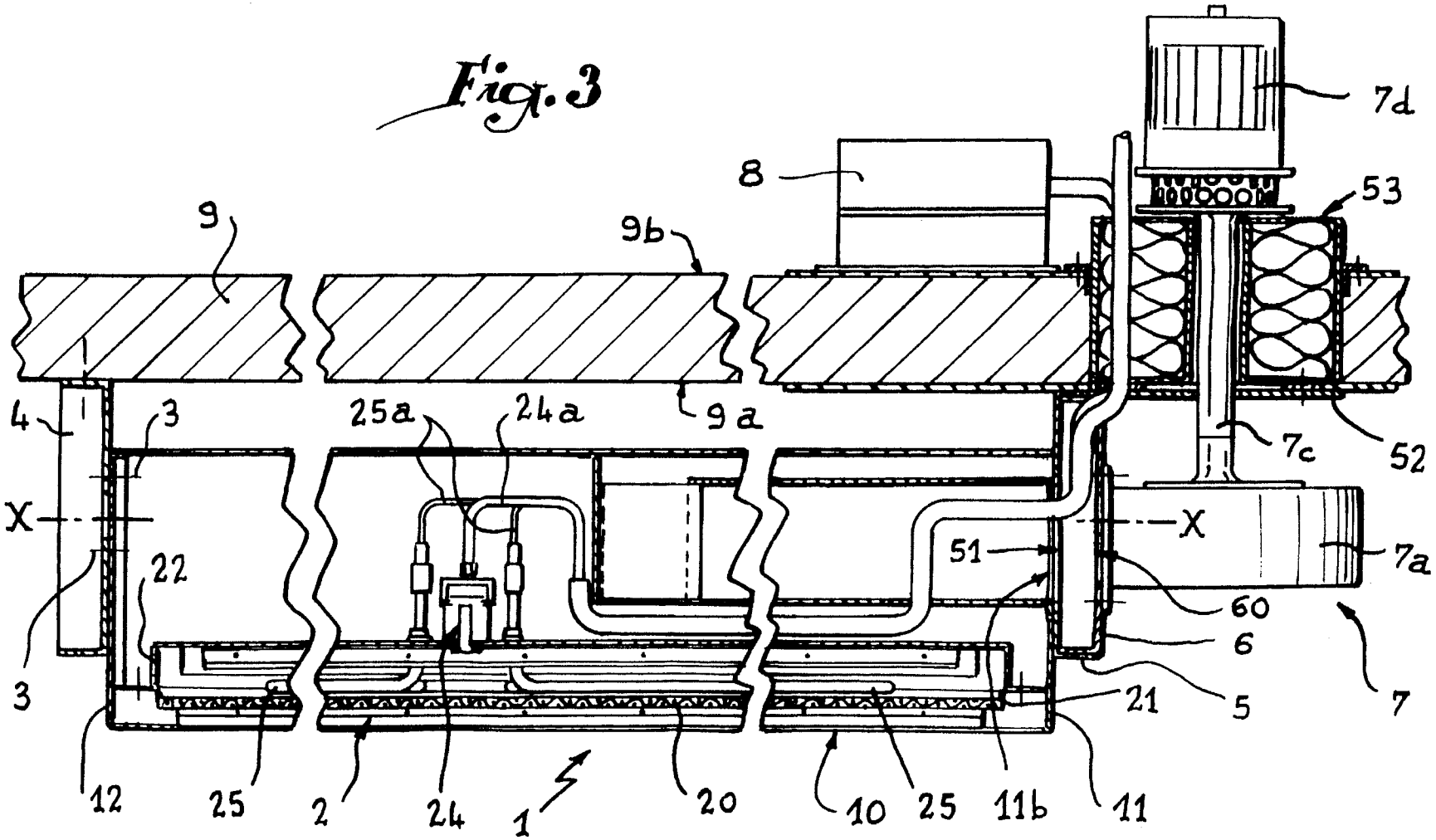
FIG. 3 is a horizontal section along III—III (FIG.2) of a furnace or the like inside which an infrared ray emitter according to the invention is installed.

As illustrated in FIG. 3, the infrared ray emitter according to the invention is fixed by its brackets 4, 5 on the inner wall 9*a* of a partition 9 of a suitably heat-insulated furnace, tunnel or oven. Bracket 5 is fixed on the partition 9 by its right-angled part 52 which is traversed by the shaft 7*c* of the electro-ventilator 7. The latter traverses this partition in heat-proof manner by any appropriate means, particularly in an insulating sleeve 53. In the same way, the pipe 24*a* for supplying the member 24 for injecting combustible gas and the leads for electrically supplying the resistors 25 traverse the partition 9 in heat-proof manner. The pipe 24*a* and the leads issue from a control box 8 which is fixed on the outer wall 9*b* of the partition 9 so as not to be exposed to the heat prevailing inside the furnace or the like.

Referring back to FIG. 1, it is observed that the outlet orifice of the housing 7*a* opens out in a corresponding opening 60 in the support plate 6 which is centered on the longitudinal geometrical axis referenced X of the box 1. Within the ring of holes 50, the bracket 5 comprises a passage 51 whose center lies on axis X. The same applies to end wall 11 which comprises a central cut-out 11*b* corresponding to the passage 51. On the contrary, end wall 12 is solid, i.e. not perforated. In this way, when the turbine 7*b* of the electro-ventilator 7 is activated the air introduced into the enclosure of the furnace or the like is expelled inside the box 1, traversing the opening 60, the passage 51 and the cut-out 11*b*, so that the box 1 constitutes a chamber for distributing the expelled air over the entire surface of the element 20.

The design of the emitter according to the invention allows it to be assembled in existing furnaces or the like without important modifications thereto and with very simple positioning. Moreover, as the air sent into the box 1 is that contained in the enclosure of the furnace or the like, the solvents emitted by the drying or polymerization of paints are burnt at element 20 impregnated with a catalytic matter, so that the gaseous medium enclosed in the furnace is automatically recycled.

Finally, as the delicate device (electric motor, control instruments) are located outside the enclosure of the furnace or the like, the monobloc emitter according to the invention may withstand high temperatures, of the order of 250° C.

It must, moreover, be understood that the foregoing description has been given only by way of example and that it in no way limits the domain of the invention which would not be exceeded by replacing the details of execution described by any other equivalents.

What is claimed is:

1. An infrared ray emitter having a catalytic burner which is adapted to be installed within a furnace, the infrared ray emitter comprising; a box having a plurality of faces defining an interior chamber and opposite first and second end walls, one of said faces defining an opening from said interior chamber of said box, a catalytic material structure mounted within said opening, means for injecting a combustible gas mounted within said chamber adjacent said catalytic material structure, a turbine means mounted to said box for introducing a combustion supporting gas under pressure into said chamber so as to distribute said combustion supporting gas over said catalytic material structure, motor means for driving said turbine means, said second end wall of said box including an inlet opening for receiving combustion supporting gas under pressure from said turbine means, electrical preheating means mounted within said chamber and adjacent said catalytic material structure for pre-heating said catalytic material structure, first and second spaced bracket members for supporting said box within the furnace, said second bracket member including an opening aligned with said inlet opening in said second end wall of said box and means for mounting said turbine means to said second bracket, whereby gas within the furnace is introduced into said interior chamber by said turbine means and thereafter exhausted from said interior chamber through said catalytic material structure and into said furnace whereby said gas within the furnace is recycled through said infrared emitter.

2. The infrared ray emitter of claim 1 including means for mounting said motor exteriorly of the furnace.

3. The infrared ray emitter of claim 2 including electrical control means mounted exteriorly of the furnace, electrical conduit means extending from said electrical control means to said electrical pre-heating means mounted within said chamber.

4. The infrared ray emitter of claim 1 including a frame member mounted within said opening, said catalytic material structure including an element impregnated with the catalytic combustion material.

5. The infrared ray emitter of claim 1 in which said means for mounting said turbine means includes a support plate having an opening therein aligned with said opening in said second bracket and said inlet opening in said second end wall of said box.

6. The infrared ray emitter of claim 5 including means for mounting said box at various angles relative to said first and second spaced brackets.

7. The infrared ray emitter of claim 1 including means for mounting said box at various angles relative to said first and second spaced brackets.

* * * * *